US006179037B1

(12) United States Patent
Tees

(10) Patent No.: US 6,179,037 B1
(45) Date of Patent: Jan. 30, 2001

(54) SCREEN RETENTION SYSTEM

(75) Inventor: Douglas G. Tees, Barrhead (CA)

(73) Assignees: Zip-in Products Limited; Yellowhead East Business Development Corporation, both of Alberta (CA)

( * ) Notice: Under 35 U.S.C. 154(b), the term of this patent shall be extended for 0 days.

(21) Appl. No.: 09/356,037

(22) Filed: Jul. 16, 1999

(51) Int. Cl.[7] ..... E06B 3/00
(52) U.S. Cl. ..... 160/368.1
(58) Field of Search ..... 160/368.1, 371, 160/370.21, 354

(56) References Cited

U.S. PATENT DOCUMENTS

| | | | | |
|---|---|---|---|---|
| 2,017,539 | * | 10/1935 | Kaplan | 160/368.1 X |
| 3,753,458 | | 8/1973 | Lazarek . | |
| 3,789,428 | | 2/1974 | Martin . | |
| 4,044,813 | | 8/1977 | Emmons . | |
| 4,068,428 | | 1/1978 | Peterson, III . | |
| 4,249,589 | | 2/1981 | Loeb . | |
| 4,395,781 | | 8/1983 | Myers . | |
| 4,398,586 | | 8/1983 | Hall . | |
| 4,426,816 | * | 1/1984 | Dean et al. | 160/368.1 X |
| 4,547,908 | | 10/1985 | Karlsson et al. . | |
| 4,685,152 | | 8/1987 | Heare . | |
| 4,831,665 | | 5/1989 | Palmaer . | |
| 4,909,004 | | 3/1990 | Panttila . | |
| 4,993,471 | | 2/1991 | Golden . | |
| 5,064,239 | | 11/1991 | Folcik . | |
| 5,423,589 | | 6/1995 | Pank . | |
| 5,489,136 | | 2/1996 | Pank . | |
| 5,653,057 | | 8/1997 | Gary . | |

FOREIGN PATENT DOCUMENTS

| | | |
|---|---|---|
| 1255968 | 6/1989 | (CA) . |
| 2129608 | 2/1996 | (CA) . |

* cited by examiner

*Primary Examiner*—Jerry Redman
(74) *Attorney, Agent, or Firm*—Sean W. Goodwin

(57) ABSTRACT

A screen retention system is provided for installing screen covers over large openings having polygonal frames comprising a plurality of mounting strips attached to a frame, each mounting strip having a plurality of posts. Each post has a substantial girth and has an enlarged head formed at its tip, the underside of the head forming a catch substantially around the entire underside. Screen material is mounted over the posts and the heads retain the screen thereon and therefore resist large lateral forces exerted by tension in the screen. A closure loop strip entangles the post heads to retain the loop strip thereon.

10 Claims, 4 Drawing Sheets

SCREEN RETENTION SYSTEM

FIELD OF THE INVENTION

This invention relates to the process of affixing covering material over openings and more particularly to a process of affixing screen material in a secure fashion over large structural openings such as a building's windows and doors.

BACKGROUND OF THE INVENTION

Means are known for providing temporary or replaceable screening over standard sized windows, often in the context of home or automobile windows. Conventional hook strip and loop strip Velcro[1] fasteners are used to affix screen to a window opening. It is known that a hook strip can be attached to a window frame and a screen is then mounted placed upon the hooks. The hooks themselves act to support the screen. It is also known to apply the loop strip thereafter which fastens onto the hook portion protruding through the screen for added strength.

When larger areas of screening are used however, for large covering openings or for enclosing skeletal framework, the lateral strength of hooks are not adequate to properly support the screen, either during the fitting of the screen, or after applying the loops.

Further, the traditional strip is prone to pull free of the frame structure, the problem becoming-more pronounced as the opening size increases.

SUMMARY OF THE INVENTION

A system is provided for mounting and retaining screen material over openings. Significant lateral tensioning strength is achieved as well as a high resistance to separation of the screen from the opening. The system enables covering of large openings heretofore not previously achieved. Further, covering of openings such as horizontal expanses, involving a large weight of screening material and imposing large lateral loading can be accomplished. Examples would be large screened area enclosures and protective agriculture screen coverage.

More particularly, a screen retention system is provided for installing screen over an opening having a polygonal frame. The system comprises securing a plurality of mounting strips to the frame, each mounting strip having a plurality of posts rising perpendicularly therefrom. Preferably, the mounting strip is first secured to a semi-rigid backing strip which is then secured to the frame. Each post has a substantial girth and has an enlarged head formed at its tip, the underside of the head forming a catch substantially around the entire underside.

Then screen material having regular apertures formed therein, is mounted onto the posts of the mounting strips by pressing the apertures of the screen over the heads of the posts. Once the screen passes the heads, the heads' catches act to retain the screen thereon. The girth of the posts resists lateral forces exerted by tension in the screen.

Then a closure loop strip is installed by entangling the loops with the post heads, the heads' catches acting to retain the loop strip thereon. Preferably the loop strip is secured to a semi rigid capping strip.

DESCRIPTION OF THE PREFERRED EMBODIMENT

Figure 1:
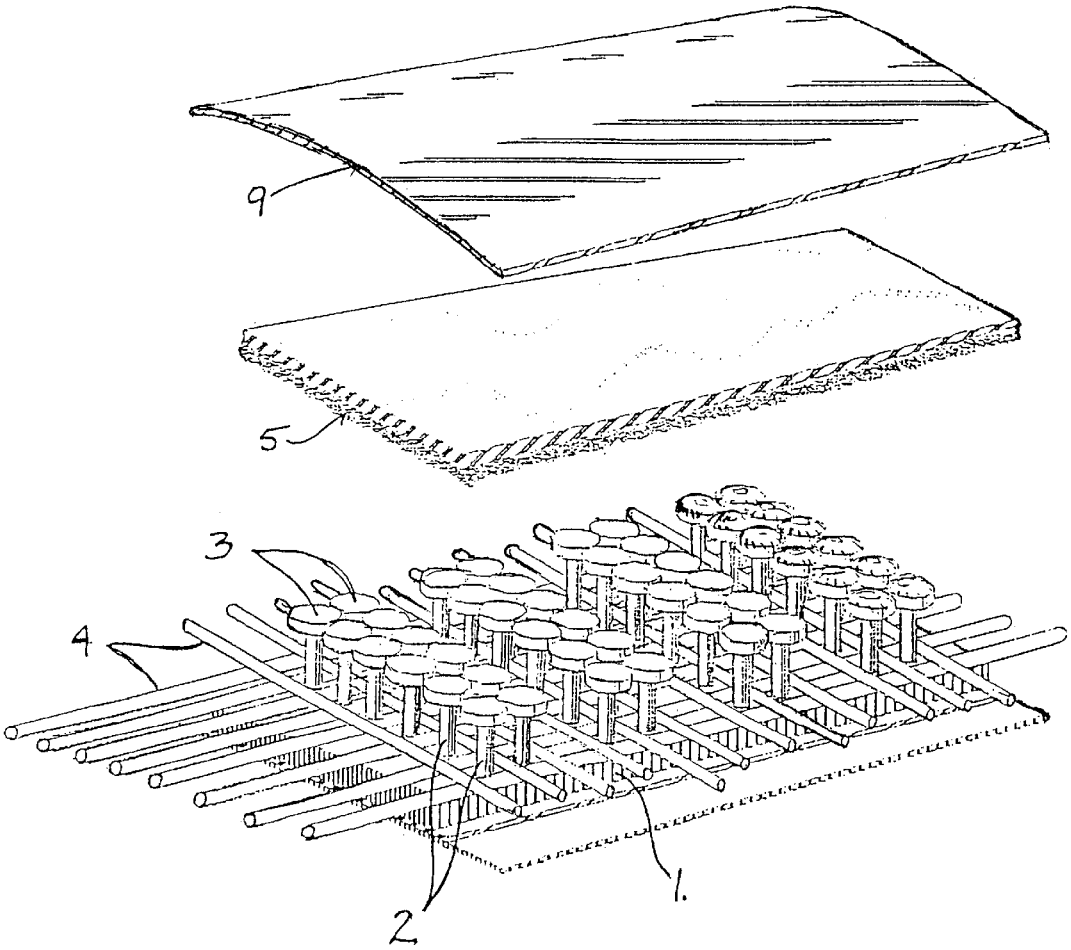
FIG. 1 is an exploded view of an embodiment of the present invention.
Figure 2:
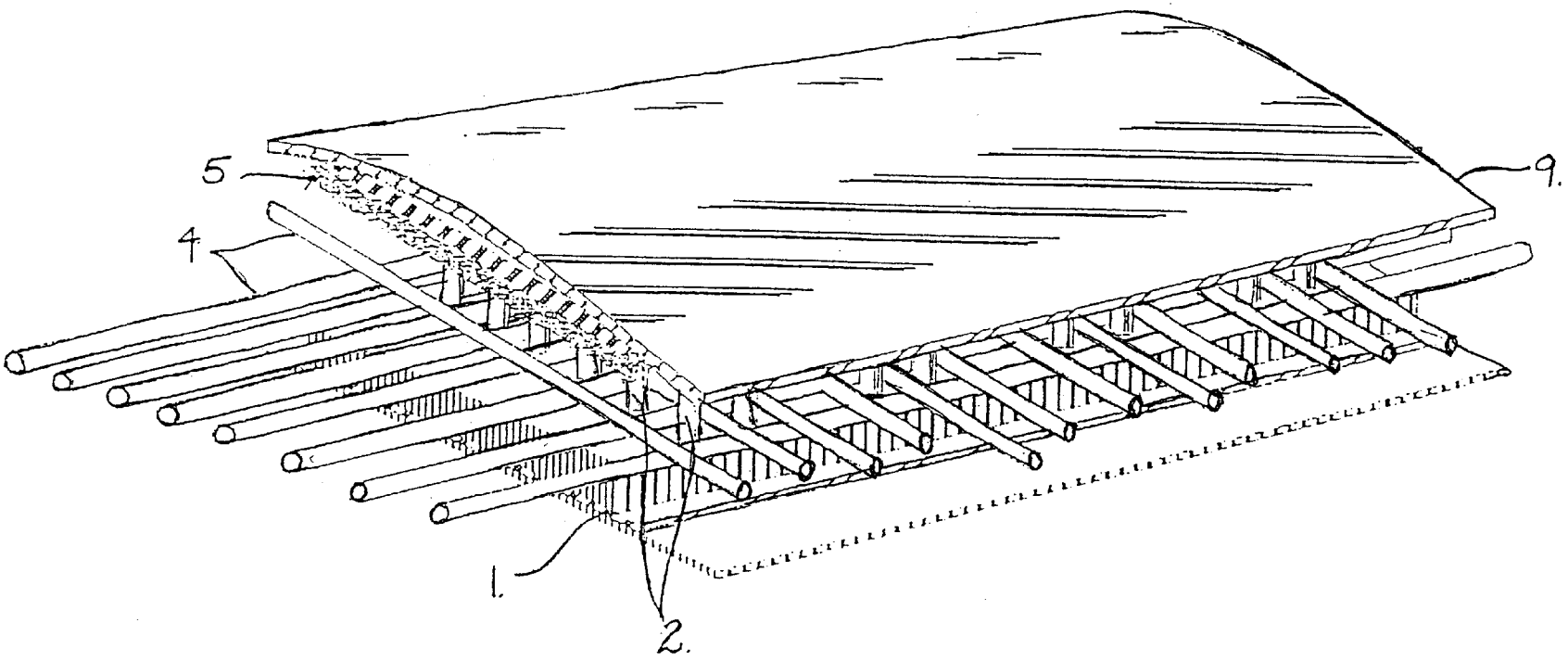
FIG. 2 is an assembled view of the embodiment depicted in FIG. 1.

Having reference to FIGS. 1 and 2, and in a first embodiment, an elongated, linear mounting strip 1 is provided having a plurality of posts 2 rising in arrays from the linear strip 1. The strips themselves are affixed to a mounting surface or frame 7.

The posts 2 have a substantial girth. Each post 2 has an enlarged head 3 formed at the tip of the post 2. The head extends completely around the post's circumference. The head 3 has a "mushroom" shape, the rounded top surface facing outwardly from the strip 1. Other head shapes include arrowhead, or nail head. The size of the head 3 is approximately the size of the opening in common screening materials 4.

The girth of the post 2 is substantial, but is slightly smaller than that of the head 3 so that the connection of the base of the head 3 to each post 2 is characterized by a perpendicular transition of material, forming a "catch". More particularly, the angle formed between the undersurface of the head 3 and the post 2 is at right angles or less. The head 3 is symmetrical therearound so as to form a catch substantially fully around the head 3. A conventional hook only creates a catch in one direction.

The density of the posts 2 arranged on the strip 1 is substantially that of window screen, at about 170 per square inch.

As shown in FIG. 1, the spacing of the posts 2 permits ready insertion or penetration through common screening material 4. Preferably, the top surface of the head 3 is rounded for ease of installing the apertures of screen material 4 thereover. It is understood that the screening material need only be about the periphery of the material covering the opening. Typically, the entire cover material is screen.

One post strip is the offering by the 3M Corporation named Dual Lock[2]. In their conventional and intended use, two Dual Lock strips are pressed into post-to-post engagement to fasten them together. The underside catches of the heads of two Dual Lock post strips engage and secure the two post strips together.

In the preferred embodiment, rather than mating like post strips 1, one post strip 1 is used for engagement with a loop strip 5.

Figure 3:
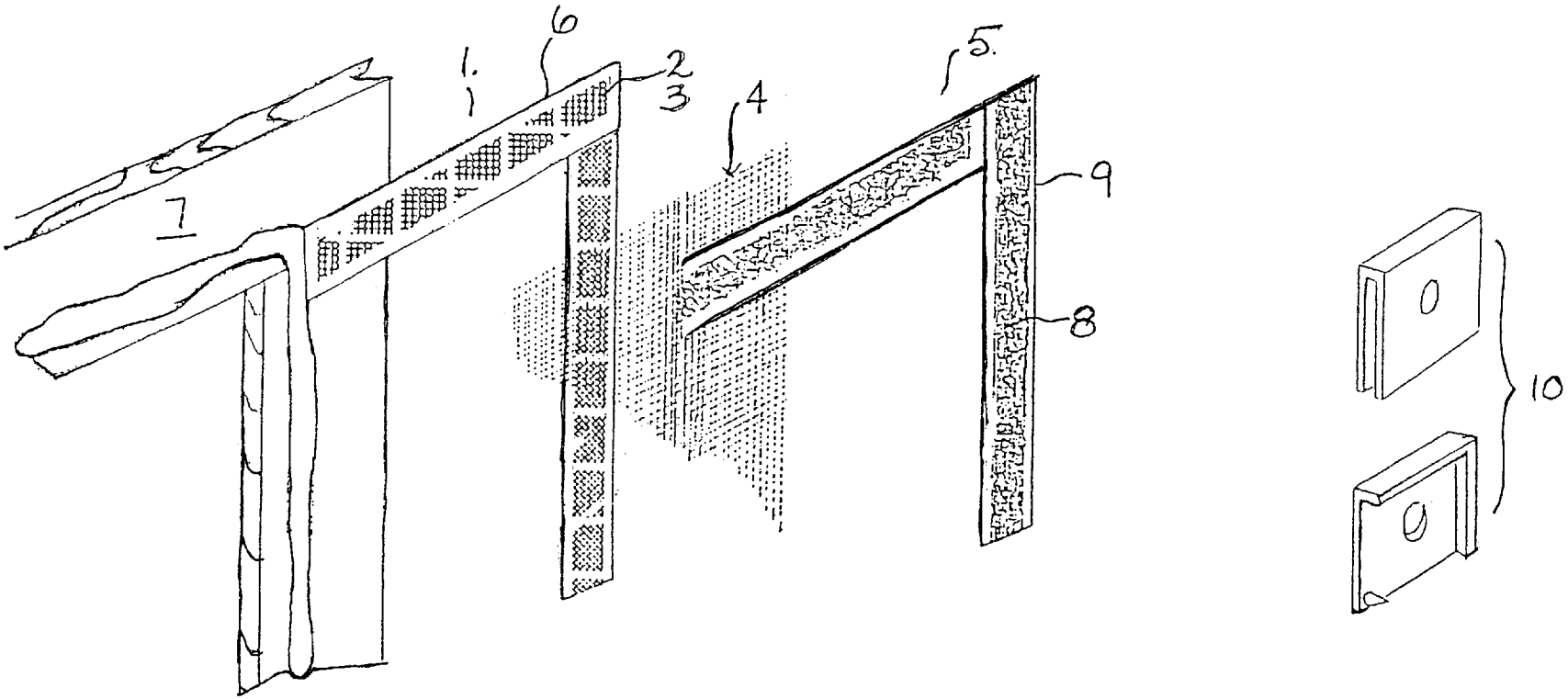
FIG. 3 depicts an enclosure frame and an exploded view of the mounting post strip, the screen and the loop strip.

As shown in FIG. 3, the posts 2 have considerable lateral strength and further, when engaged with a loop strip 5, much greater pulling force is required to separate the posts 2 and loops 8 than is experienced with conventional hook and loop Velcro applications.

Figure 4:
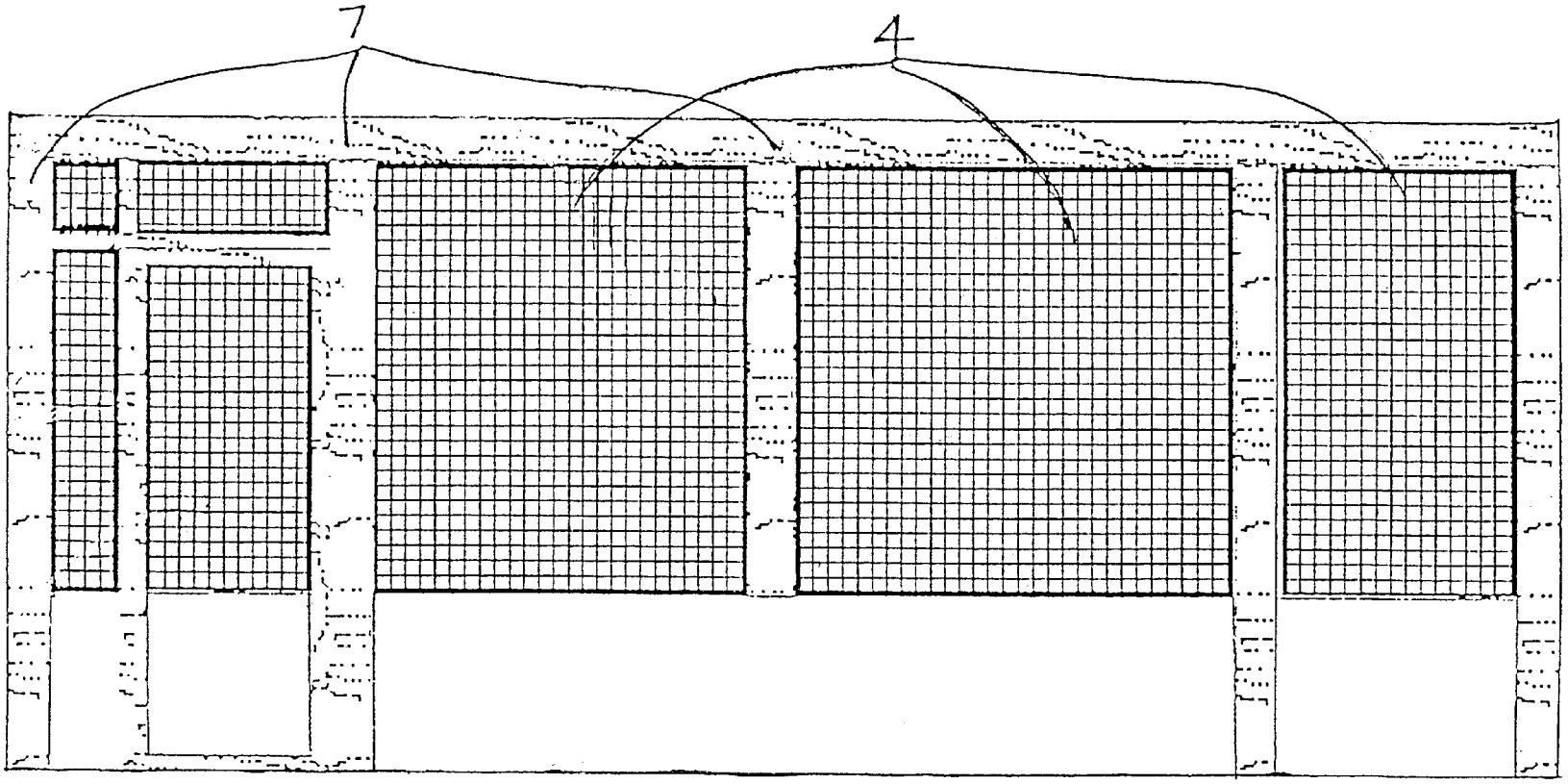
FIG. 4 illustrates application of the screen retention system to an enclosure's wall.

When large areas must be screened, as shown in FIG. 4, the lateral forces can be large, particularly as the screen weight increases or, as in horizontal installations, the screen in-plane tension increases.

Large areas also increase the external forces (i.e. wind) which act on the exposed screen to pull the screen 4 perpendicularly off of the strip 1. The loop 8 and head 3 combination provides high resistive force.

The strips themselves must resist the large forces transmitted from the post strip 1, into the frame 7. Typical hook and loop strips use a synthetic backing to which the hooks or loops are attached. Similarly, the post strip 1 is formed of plastic material.

While in some instances the strip backing is suitable to resist separation from the mounting surface, the greater is the area screened, the greater is the risk of backing separation.

Accordingly and with reference to FIG. 3, in a second embodiment, the post strip 1 is secured to a semi-rigid backing strip 6 using a suitable adhesive. Suitable backing strip 6 material is aluminum strip, similar to that used in venetian blinds. Similarly, wood or plastic could be used with the appropriate compatible adhesive. Adhesive provides a force-distributed attachment. The backing strip 6 is then secured to the frame 7 using adhesive or mechanical fasteners. Preferably, ½" wide post strip is used with a 1" backing strip.

During installation, the post strip 1, alone or mounted already to a backing strip 6, is arranged around the periphery of an opening such as a large window, or an open framework.

The screen material 4 is arranged to cover the desired opening. The screen 4 is placed over one corner or edge of the post strip 1. The screen 4 is pressed onto the posts 2, the screen openings passing over the post heads 3 and resting positioned about the posts 2. The screen 4 resists pulling from of the posts 2 due to the interference with the underside catch of the heads 3.

The screen 4 is successively pressed over the post strip 1, in a zipper-like action. The heads 3 of the post protrude through the screen 4. As more and more of the screen 4 is secured to the post strip 1, the posts 2 support more and more load, which manifests as a lateral force. The posts 2 are sufficiently strong in the lateral direction to permit an installer to place tension into the screen material 4 during installation and thus minimize wrinkles in the screen 4.

The posts 2 resist release of the screen material 4 sufficiently to permit the entire screen 4 to be installed. Once fully installed, the loop strip 5 can be placed into engagement with the protruding heads 3 of the post strip 1. The loops 8 of the loop strip 5, like the screen 4, resist separation from the heads 3 due to interference or entanglement with the underside catches of the heads 3.

Preferably, the loop strip 5 is secured to a semi rigid capping strip 9 using a suitable adhesive. Like the backing strip material, the capping strip 9 is formed of aluminum strip. The capping strip 9 aids in maintenance of the loop strip's 5 form for ease of installation, increases its pull-away resistance and provides an attractive, finished appearance. Corner caps 10 can be used to finish comers.

What is claimed is:

1. A system comprising:

a) a frame about at least the periphery of an opening;

b) a covering material having a periphery which overlaps the frame, at least the periphery of which is formed of a screen material which has a multiplicity of apertures formed therein;

c) a multiplicity of posts projecting upwardly from a mounting strip affixed to the frame, the number of posts being substantially the same as the number of apertures in the screen material, each post having a girth which is substantial, and an enlarged head having an underside forming a circumferential catch; and d) a plurality of removable capping strips for installation about the periphery of the covering material, the capping strips having a plurality of loops formed thereon so that when the multiplicity of apertures of the screen material are installed over the multiplicity of post heads and the capping strips are installed with the loops engaging the post heads, then the capping strip securely retains the screen material and cover to the mounting strip whereby the cover can be retained to the frame.

2. The system as recited in claim 1 wherein the covering material is screen material.

3. The system as recited in claim 1 wherein the mounting strip is secured to a semi-rigid backing strip which can be secured to the frame.

4. The system as recited in claim 3 wherein the semi-rigid backing strip can be secured to the frame using fasteners.

5. The system as recited in claim 4 wherein the covering material is screen material.

6. A removable covering comprising:

a) covering material having a periphery which can overlap a frame and wherein at least the periphery is formed of a screen material which has a multiplicity of apertures formed therein;

b) mounting strips adapted for affixing to said frame, the strip having a multiplicity of posts projecting upwardly therefrom a mounting strip, the number of posts being substantially the same as the number of apertures in the screen material, each post having a girth which is substantial, and an enlarged head having an underside forming a circumferential catch; and c) capping strips for installation about the periphery of the covering material, the capping strips having a plurality of loops formed thereon so that when the multiplicity of apertures of the screen material are installed over the multiplicity of post heads, and the loops engage the post heads, the capping strip securely retains the screen material and cover to the mounting strip whereby the cover can be retained to said frame.

7. The removable covering as recited in claim 6 wherein the covering material is screen material.

8. The removable covering as recited in claim 6 wherein the mounting strip is secured to a semi-rigid backing strip which can be secured to the frame.

9. The removable covering as recited in claim 8 wherein the semi-rigid backing strip can be secured to the frame using fasteners.

10. The removable covering as recited in claim 9 wherein the covering material is screen material.

* * * * *